350-333 AU 254
10/27/87 XR 4,703,305

United States Patent [19]

Ayliffe

[11] Patent Number: 4,703,305

[45] Date of Patent: Oct. 27, 1987

[54] ADDRESSING SMECTIC DISPLAYS

[75] Inventor: Peter J. Ayliffe, Stansted, England

[73] Assignee: STC plc, London, England

[21] Appl. No.: 754,544

[22] Filed: Jul. 12, 1985

[30] Foreign Application Priority Data

Jul. 12, 1984 [GB] United Kingdom ..... 8417829

[51] Int. Cl.[4] ..... G09G 3/36

[52] U.S. Cl. ..... 340/784; 340/805; 350/333; 350/350 S

[58] Field of Search ..... 340/784, 805; 350/332, 350/333, 783, 802

[56] References Cited

U.S. PATENT DOCUMENTS

| | | | |
|---|---|---|---|
| 3,976,362 | 8/1976 | Kawakami | 340/784 |
| 3,995,942 | 12/1976 | Kawakami et al. | 340/784 X |
| 4,040,721 | 8/1977 | Kurita | 340/784 X |
| 4,062,626 | 12/1977 | Kawakami et al. | 340/784 X |
| 4,231,035 | 10/1980 | van Doorn et al. | 340/784 |
| 4,370,647 | 1/1983 | Drantinghorm | 340/784 |
| 4,378,557 | 3/1983 | Murata | 340/784 X |
| 4,413,256 | 11/1983 | Yasuda et al. | 340/784 |
| 4,427,979 | 1/1984 | Clerc et al. | 340/784 X |
| 4,469,999 | 8/1984 | Tsuzuki et al. | 340/784 |
| 4,560,982 | 12/1985 | Sonehara et al. | 340/784 |

*Primary Examiner*—Gerald L. Brigance
*Attorney, Agent, or Firm*—Lee, Smith & Zickert

[57] ABSTRACT

In operating a display device incorporating a matrix addressed smectic cell, a strobing pulse is applied to each row electrode in turn while data pulses are applied in parallel to the column electrodes. The data pulse voltage excursion is less than the minimum voltage $V_T$ required to switch the cell. For the entry of complete rows the strobing voltage excursion is made larger than twice $V_T$ for fast data entry. For entry of rows in successive segments (e.g. for single character entry) the strobing voltage is less than twice $V_T$ so that successive strobing pulses applied to a single line may be of longer duration but cannot give rise to spurious switching of unselected pixels.

3 Claims, 1 Drawing Figure

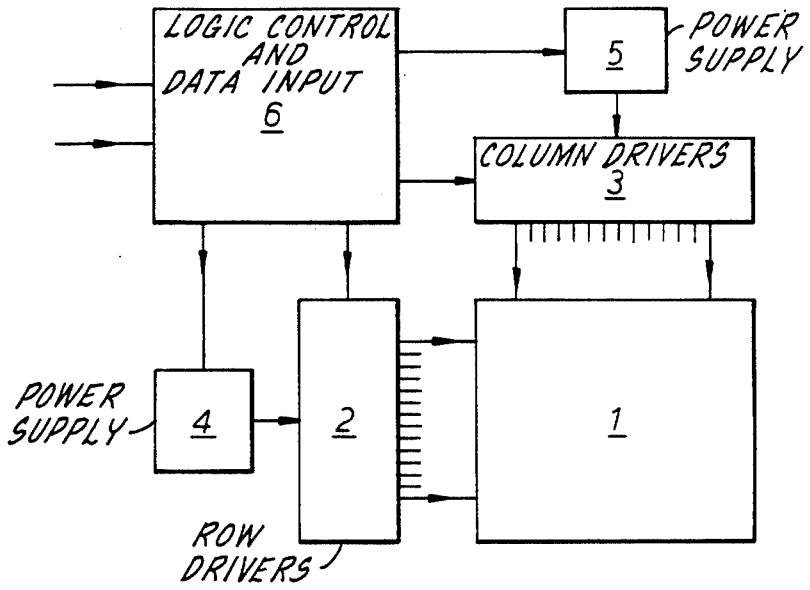
LOGIC CONTROL AND DATA INPUT
6
5
POWER SUPPLY
COLUMN DRIVERS
3
POWER SUPPLY
4
2
1
ROW DRIVERS

ADDRESSING SMECTIC DISPLAYS

FIELD OF THE INVENTION

This invention relates to the entering of data into a matrix-addressed smectic cell and is particularly concerned with a manner of driving a smectic cell in such a way that allows entry of successive characters in a row.

BACKGROUND OF THE INVENTION

A conventional matrix-addressed smectic cell has a first set of electrodes, row electrodes, which are intersected by a second set, column electrodes, that extend across the first set. In this way the position of a pixel, that is the area of intersection of any individual row electrode with any individual column electrode, is uniquely defined by its row number coupled with its column number.

Although in conventional usage the term 'row' is normally reserved for electrodes that extend from side to side of the display area, and 'column' for those that extend from top to bottom, for the purposes of this specification the terms 'row' and 'column' are to be understood as not restrictive as to the direction in which they extend. Thus, for instance, any reference to a row of characters will normally refer to a set of characters extending in a single line across the display in the manner conventionally employed for setting out consecutive alphanumeric characters or arranged in a line extending up and down the display in the manner conventionally employed for setting out a sequence of Chinese ideograms.

A conventional method for entering data into a matrix addressed liquid crystal cell is to write the data a line at a time by applying a strobing pulse of voltage $V_s$ to each row electrode in turn while the column electrodes are fed in parallel with data pulses of voltage $\pm V_D$. The unselected row electrodes, that is the electrodes of all the rows other than that currently receiving the strobing voltage $V_S$, are held at zero volts. Thus the potential developed across a pixel while its row is being strobed is $(V_S+V_D)$ or $(V_S-V_D)$ according to whether it is to be written into a '1' state or a '0' state. When other rows are being strobed the potential developed across the pixel is $V_D$.

A smectic liquid crystal display exhibits storage and its response to a drive signal can be cumulative. If a pixel is switched into a particular state by a pulse of a particular voltage and duration, it will in general be possible to switch that pixel to the same extent in a shorter time by using a pulse or larger voltage. Conversely the use of a lower voltage will require a pulse of longer duration. In any particular instance there will be a threshold voltage value $V_T$ which requires a pulse of infinite duration to achieve the requisite switching, or partial switching. Although $V_T$ has been defined in terms of a mathematical limit, it is nevertheless a real physical quantity that may be readily determined in the laboratory to any desired degree of accuracy, since a voltage even slightly above $V_T$ will achieve switching in a finite time and the limiting value of $V_T$ may be readily extrapolated from several finite measurements.

Clearly if $V_D<V_T$ and $(V_S-V_D)<V_T$ unselected elements are never exposed to a voltage equal to or greater than $V_T$, and hence no amount of switching on of selected elements will ever give rise to the spurious switching on of any unselected element. However, a corollary of this is that the switching voltage $(V_S+V_D)$ to which selected elements are exposed is limited to a value which must be less than $3V_T$.

When data is being entered into a smectic display in a mode that involves the entry of the data in complete lines, a complete line at a time, the unselected pixels of that line see $(V_S-V_D)$ for the same duration as the selected pixels see $(V_S+V_D)$. The cell exhibits storage, and hence there is no need to refresh that line, which therefore will remain until it needs to be updated. When the line does need updating it will be cleared before entry of the revised data. It is seen therefore, that an unselected element may see an indeterminite number of pulses of voltage $V_D$ while other rows are being addressed, but it can expect to see only one pulse of voltage $(V_S-V_D)$. Clearly, for absolute safety, $V_D$ must be kept less than $V_T$ since there is no certain limit to the cumulative exposure of the element to this voltage, but on the other hand its exposure to $(V_S-V_D)$ is for a strictly limited duration, the duration required to switch a selected pixel with the voltage $(V_S+V_D)$. It follows therefore, that to restrict the value of $V_S$ to a value which will satisfy the relationship $(V_S-V_D)<V_T$ is to impose an unnecessarily severe requirement upon the system. $V_S$ can be significantly increased to produce a correspondingly significant saving in the required duration of the pulses. For this reason it is generally appropriate, whenever data is to be entered into the display in a mode where an entire row of pixels is entered with a single strobing pulse, to use a large strobing voltage $V_S>2V_T$ in order to increase the rate at which lines can be entered. This mode of data entry is which an entire row of pixels is entered with a single pulse will be termed 'whole row entry mode'.

For some applications however, it may not be desirable or even possible to wait for the data of an entire row before beginning to display parts of that row. A particular example of such an application is when the display is required to display each character of a line of alphanumeric characters as it is entered into the system for instance directly from a keyboard. Each of these characters of a character line will need to be entered to the right of its predecessor. If each character is formed by a matrix of 'x' by 'y' pixels, and the top left-hand pixel of the first character of a line has the co-ordinates (r,s), then rows 's' to 's+y−1' will need to be strobed for entry of that character. The data for entry of that character will be confined to columns 'r' to 'r+x−1'. All the other columns will be unselected columns. Entry of the next character will involve a repetition of the strobing of rows 's' to 's+y−1', but in this instance the data entry is confined to columns 'r+x' to 'r+2x−1', all other columns being unselected. Therefore, upon entry of the second character all pixels of rows 's' to 's+y−1' that have a column co-ordinate of 'r+2x' or greater will receive a second unselected pixel pulse of voltage $(V_S-V_D)$. If 'whole row entry mode' strobing pulse voltage levels are used, the entry of a succession of different segments of a row is liable soon to run into the problem that an accumulation of $(V_S-V_D)$ pulses will be sufficient to cause a spurious writing of unselected elements. A data entry mode that involves the entry of a succession of different segments of a row will be termed 'segmented row entry mode'.

One way of overcoming this problem of the spurious writing of unselected elements in segmented row entry mode is to arrange to erase the row between each consecutive data entry into that row. Clearly this requires that the pre-existing data of that row is at least temporarily stored elsewhere so that it is not lost upon erasure, but is available for re-entry with the data pertaining to the entry of the next character. The resulting temporary loss of display of a row immediately prior to the entry of a fresh segment might be acceptable in some circumstances if it were not for the fact that it is found that the temporary erasure is associated with a temporary brightening of the background during the erasure. The result is that this approach to solving the problem of spurious writing of unselected elements when using segmented row entry mode produces its own problem namely that the row 'flashes' in a most distracting way.

SUMMARY OF THE INVENTION

According to the present invention there is provided a display device incorporating a matrix addressed smectic cell whose pixels are addressed by means of a strobe pulse applied to successive rows in sequence, and in synchronisation with the parallel input of data pulses to the column electrodes, wherein the voltage excursion of the data pulses is less than the threshold voltage value, $V_T$ sufficient just to switch the cell if applied across its electrodes for an infinitely long period; which device includes means for switching the addressing of the cell between a whole row entry mode and a segmented row entry mode, wherein in the whole row entry mode the pulses are of relatively shorter duration and the voltage excursion of the strobe pulses is greater than twice $V_T$, while in the segmented row entry mode the pulses are of relatively longer duration and the voltage excursion of the strobe pulses is less than twice $V_T$.

The invention also provides a method of operating a display device incorporating a matrix addressed smectic cell, wherein the pixels of the cell are addressed by means of a strobe pulse applied to successive rows in sequence, and in synchronism with the parallel input of data pulses to the column electrodes, wherein the voltage excursion of the data pulses is less than the threshold voltage value, $V_T$, sufficient just to switch the cell if applied across its electrodes for an infinitely long period, wherein, for data that is to be entered a whole row at a time, having first erased that row, the data pertaining to a row is entered using a strobing pulse of relatively shorter duration whose voltage excursion is greater that twice $V_T$, and wherein for data that is to be entered into a row in a sequence of time-spaced segments the data pertaining to a row is entered using a sequence of strobing pulses of relatively longer duration whose voltage excursion is less than twice $V_T$, only the first member of the sequence being preceded by the erasure of that row.

BRIEF DESCRIPTION OF THE DRAWING

The accompanying drawing is a block diagram of the basic constituents of the described display device.

DETAILED DESCRIPTION OF A PREFERRED EMBODIMENT

In accordance with the present invention, the solution to the problem of spurious writing of unselected elements when using segmented row entry mode is to change the voltage drive levels whenever changing between whole row entry mode and segmented row entry mode. In whole row entry mode a relatively high strobing voltage is used so that data can be entered rapidly, but whenever segmented row entry mode is being employed the strobing voltage is reduced to a value to make it impossible for unselected pixels to become spuriously written. This reduction in voltage means that the pulses should be lengthened, and hence data entry is slower than in whole row entry mode, but typically this is of no significance because the rate will normally be limited by the rate at which data is capable of being furnished rather than the rate at which it can be entered. For instance, if the data that is being entered takes the form of character entry from an alphanumeric keyboard, the rate of character generation will typically be slow enough to permit each row segment to be the width of a single character, so that characters are entered into the display singly as they are generated. If however, the character generation is too fast for this to be feasible, it is possible to lengthen the row segments to speed up data entry. Thus by lengthening the segments to the width of two characters the characters are entered in pairs rather than singly, and the data entry rate is doubled.

The foregoing description has referred to the use of a strobing voltage $V_S$ in conjunction with data voltage of $\pm V_D$. With unidirectional voltage pulses the interpretation of these expressions is trivial; thus if the data voltage is $+V_D$ the potential difference developed across the pixel is $V_S - V_D$, and conversely if the data voltage is $V_D$ the potential difference is $(V_S + V_D)$. Generally however, it is preferred to address the smectic cell with an alternating voltage rather than a unidirectional one. To produce equivalence of the analysis in the two cases, $V_S$ and $V_D$, when used in connection with alternating voltages, refer to the peak-to-peak voltages of alternating voltage pulses; $+V_D$ signifies that the phases of the data pulse waveform registers with that of the strobing pulse, while $-V_D$ signifies that it is in antiphase.

Referring to the drawing, the basic elements of a preferred embodiment of display device according to the present invention comprise a display cell 1, row and column drivers 2 and 3, row and column power supplies 4 and 5, and a logic control and data input unit 6. The logic unit 6 may have separate inputs for the entry of data furnished in whole row entry mode and for the entry of data furnished in segmented row entry mode. Alternatively these may be entered on a common input which is switched internally under the control of a separate input that identifies the mode. The logic unit 6 controls the operation of the power supplies 4 and 5 so that they apply the appropriate inputs to the row and column drivers 3 and 4 according to the desired operation. Thus they will supply erasure voltages to both drivers when erasure is required, and data entry voltages when data entry is required. Generally, the data voltage supply, $\pm V_D$, from the column power supply 5 to the column driver 3 does not need to be changed when changing mode from whole row entry to segmented row entry, whereas the strobe voltage supply, $\pm V_S$, from the row power supply 4 to the row driver 2 does need to be changed with change of data entry mode. The logic unit 6 also controls the operation of the row and column drivers 2 and 3, providing them with data and clock inputs, and also control inputs that regulate the duration of the data entry pulses that the drivers apply to the cell, this duration being different for the two types of data entry mode.

By way of example, typical operating parameters will now be quoted for a particular display cell whose envelope enclosed a twelve micron thick layer of a positive dielectric anisotropy cyanobiphenyl smectic material marketed by BDH under the designation "S4" doped with a hexadecyltrimethyl-ammonium salt to provide the layer with the requisite anisotropic conductivity to enable the generation of electrohydrodynamic scattering. The pixels of this cell were "cleared", that is set into the scattering state, by the application of a low frequency square-wave signal typically between 0 and 200 Hz with a peak-to-peak amplitude of about 520 volts, and a duration of about 40 msec. A signal of half amplitude was applied simultaneously to all the row electrodes while an antiphase signal of equivalent amplitude was applied simultaneously to all the column electrodes in order to clear the whole display at a single go. When however, it was desired to clear only selected rows the phase of the signal applied to the unselected rows was reversed so that their pixels were not exposed to any erasing field. In complete line entry mode selected pixels were addressed using a higher frequency signal, typically about 1.5 KHz, with a peak-to-peak data voltage $V_D$ of 80 volts and a peak-to-peak strobing voltage $V_S$ of 260 volts. At this frequency and signal strength switching into the clear state was achieved with a pulse length of about 2 msec, and hence a display page of 400 lines of pixels could be entered in about 800 msec using complete row entry mode. The voltage threshold $V_T$ at 1.5 KHz was in the region of 40 volts, and hence for the segmented row entry the strobe voltage was typically reduced to about 160 volts peak-to-peak. This meant that the pulse length had to be extended to about 10 msec. In the case of characters built up from a matrix of 16 by 9 pixels, 16 rows of pixels have to be strobed in order to enter a fresh character and this will take 160 msec. Thus if fresh characters are to be entered singly they must not be generated at a rate greater than 6.25 characters per second. This rate can be increased by a factor 'n' provided that it is acceptable for the characters to be entered in groups of 'n' characters.

Although the invention has been described in reference to a particular example, other embodiments will doubtless be obvious to the skilled artisan without departing from its essential teachings. Accordingly, its scope may be as broad and as diverse as is set forth in the following appended claims.

I claim:

1. In a matrix-addressed smectic liquid crystal display device of the type having:

a display cell containing a smectic liquid crystal material sandwiched between a plurality of row electrodes and a plurality of column electrodes thereby defining a matrix of pixels, said cell having an associated threshold voltage $V_T$ such that after an above-threshold voltage greater than said threshold voltage $V_T$ has been applied for a predetermined duration between a first one of said row electrodes and a second one of said column electrodes, the liquid crystal material at the particular pixel defined by the intersection of said first and second electrodes will be switched from a first state to a second state and such that after a below-threshold voltage has been applied therebetween for less than said predetermined duration, said liquid crystal material at said particular pixel will not be switched from said first state to said second state, row driver means for selectively applying a strobe pulse voltage $V_R$ have a predetermined pulse duration to a selected one of said plurality of row electrodes, column driver means for applying data in parallel to said plurality of column electrodes in the form of data pulses each having a duration shorter than said predetermined duration and a data pulse voltage $V_C$ such that selected pixels in a selected row will be subjected to a first switching voltage of $V_R+V_C$ and non-selected pixels in said selected row will be subjected to a second switching voltage of $V_R-V_C$ and such that the pixels in a non-selected row will be subjected to a third switching voltage of $\pm V_C$, wherein the absolute value of said first switching voltage is at least twice said threshold voltage $V_T$ and wherein the absolute value of said third switching voltage is less than said threshold voltage $V_T$, restoring means for switching all the pixels defined by a selected row electrode to said first state, the improvement comprising:

logic control means for selectively enabling a whole row entry mode and a segmented row entry mode; and power supply means responsive to said logic control means for supplying when said device is to be operated in said said whole row entry mode a first strobe pulse voltage $V_{R1}$ greater than twice said threshold voltage $V_T$ such that said second switching voltage will be greater than said threshold voltage $V_T$ and writing speed in said whole row entry mode will thereby be optimized, and for supplying when said device is to be operated in said said segmented row entry mode a second strobe pulse voltage $V_{R2}$ less than twice said threshold voltage $V_T$ such that even after after repeated applications of said second strobe pulse voltage $V_{R2}$ to said given row in said segmented row update mode an unselected pixel will not be switched to said second state and will not have to be restored to said first state by said restoring means.

2. The display device of claim 1 wherein said logic control means comprises means for changing the duration of said strobe pulses and in said whole row entry mode said strobe pulses are of shorter duration relative to their duration during said segmented row entry mode.

3. A method of operating a display device incorporating a matrix addressed smectic cell, wherein pixels of the cell are addressed by means of a strobe pulse applied to a selected row in synchronism with the parallel input of data pulses to column electrodes and wherein the voltage excursion of the data pulses is less than a predetermined threshold voltage $V_T$, said method comprising:

(a) for row data that is to be entered a whole row at a time, first erasing said whole row and then entering said row data using a strobing pulse of a first duration whose voltage excursion is greater than twice said predetermined threshold voltage $V_T$, and (b) for segment data that is to be entered into a particular row in a sequence of time-spaced segments, first erasing said particular row in its entirety and then entering said segment data pertaining to said particular row using a sequence of time-spaced segments without any intervening erasing step, using a sequence of strobing pulses each of a second duration longer than said first duration and whose voltage is less than twice said predetermined threshold voltage $V_T$.

* * * * *